US010113381B2

(12) United States Patent
Swinford

(10) Patent No.: US 10,113,381 B2
(45) Date of Patent: Oct. 30, 2018

(54) DOWNHOLE AMPLIFICATION TOOL

(71) Applicant: Coil Tubing Technology, Inc., Spring, TX (US)

(72) Inventor: Jerry L. Swinford, Spring, TX (US)

(73) Assignee: Coil Tubing Technology, Inc., Houston, TX (US)

( * ) Notice: Subject to any disclaimer, the term of this patent is extended or adjusted under 35 U.S.C. 154(b) by 361 days.

(21) Appl. No.: 14/608,127

(22) Filed: Jan. 28, 2015

(65) Prior Publication Data

US 2015/0211317 A1 Jul. 30, 2015

Related U.S. Application Data

(60) Provisional application No. 61/932,629, filed on Jan. 28, 2014.

(51) Int. Cl.
*E21B 31/107* (2006.01)
*E21B 31/113* (2006.01)

(52) U.S. Cl.
CPC ..... *E21B 31/113* (2013.01)

(58) Field of Classification Search
CPC ..... E21B 31/113; E21B 31/107
See application file for complete search history.

(56) References Cited

U.S. PATENT DOCUMENTS 2,766,451 A * 10/1956 Gannon ..... B25C 1/12 227/9
3,361,220 A * 1/1968 Brown ..... E21B 4/08 173/121
3,498,389 A 3/1970 Tibbott
3,512,590 A 5/1970 Tibbott
3,512,591 A 5/1970 Kulman
3,612,191 A 10/1971 Martini
3,724,560 A 4/1973 Tibbott
3,802,516 A 4/1974 Speicher
3,804,180 A 4/1974 Gelfand et al.
3,892,279 A 7/1975 Amtsberg
4,070,755 A * 1/1978 Carter ..... H01R 43/22 173/120
4,106,571 A 8/1978 Stone
4,290,489 A 9/1981 Leavell
4,300,282 A 11/1981 Bunyea et al.
4,346,770 A 8/1982 Beck
4,401,161 A 8/1983 Warren
(Continued)

*Primary Examiner* — David J Bagnell
*Assistant Examiner* — Brandon M Duck
(74) *Attorney, Agent, or Firm* — Melissa M. Martinez; Martinez Law Group PLLC

(57) ABSTRACT

An exemplary embodiment of the amplification device generally includes amplification springs, complementary amplification spring seats for the respective ends of the amplification springs, and a corresponding hammer and anvil surface. A knocker bit comprises an impact surface on its upper end for interacting with the hammer surface of an impact tool, and a hammer surface on its lower end proximate its downward facing amplification spring seat. A bottom sub provides the corresponding anvil surface at its upper end proximate its upward facing amplification spring seat. The amplification device is used with an impact tool wherein the device amplifies the impact loads. The amplification device may be utilized with an oscillating device to provide rotational frequency in addition to the amplification device's axial frequency.

20 Claims, 11 Drawing Sheets

(56) References Cited

U.S. PATENT DOCUMENTS

| | | | | |
|---|---|---|---|---|
| 4,494,615 | A | 1/1985 | Jones | |
| 5,267,613 | A | 12/1993 | Zwart et al. | |
| 6,164,393 | A | 12/2000 | Bakke | |
| 6,283,229 | B1 | 9/2001 | Wentworth et al. | |
| 6,655,568 | B2 | 12/2003 | Thieleke | |
| 7,055,542 | B2 | 6/2006 | Delobel et al. | |
| 7,156,190 | B2 | 1/2007 | Ottestad et al. | |
| 7,686,102 | B2 | 3/2010 | Swinford | |
| 2007/0175646 | A1 | 8/2007 | Preston et al. | |
| 2009/0301744 | A1* | 12/2009 | Swinford | E21B 4/14 173/200 |
| 2010/0078219 | A1 | 4/2010 | Swinford | |
| 2012/0247757 | A1 | 10/2012 | Swinford | |

* cited by examiner

DOWNHOLE AMPLIFICATION TOOL

CROSS-REFERENCE TO RELATED APPLICATIONS

This application claims the benefit of U.S. Provisional Application No. 61/932,629 filed on Jan. 28, 2014, which application is incorporated herein by reference as if reproduced in full below.

STATEMENT REGARDING FEDERALLY SPONSORED RESEARCH OR DEVELOPMENT

Not applicable.

FIELD OF THE DISCLOSURE

The disclosure relates generally to impact devices for use during downhole operations. More specifically, the disclosure is directed to the amplification of impact devices for use during downhole operations.

BRIEF SUMMARY OF THE DISCLOSURE

Impact devices, commonly known as jars, are typically deployed during well drilling in order to deliver an impact load to an item when needed during operations for a variety of reasons. Some reasons may include: the need to utilize shearing screws or pins in order to set or release a device, the need to unseat valves in order to allow for their removal; the need to strike or "jar" a stuck drill pipe; the use during fishing operations; drilling through various types of plugs; to drive debris downhole; and to remove paraffin, scale, sludge, and tar. The present disclosure provides a device that may be used to amplify the intensity of an impact device.

The amplification device may be used to prevent a work string from stalling, or frictioning out, in extended reach lateral drilling. This stalling may occur when a large number of plug drill outs are required; usually ten or more. The amplification tool can generate dual impact cycles (up and down) in excess of five hundred cycles per minute. This allows it to create a pushing and pulling force on the tool body.

An exemplary embodiment of the amplification device generally includes amplification springs, complementary amplification spring seats for the respective ends of the amplification springs, and a hammer surface with an opposing anvil surface. At least two amplification springs are utilized. The inner amplification spring is smaller in both diameter and length in relation to the outer amplification spring. The inner amplification spring fits at least partially within the outer amplification spring when the amplification device is assembled. The inner amplification spring may be less compressible than the outer amplification spring. The amplification springs may be positioned in a concentric relation once installed in the amplification device. One purpose of the dual springs is to take up the additional stroke of the impact tool's piston when the tool bottoms out. This allows the dual springs of the amplification device to support the impact tool so the springs of the impact tool do not continually flatten out.

A knocker bit is provided having a hammer surface on its lower end. The knocker bit also has an anvil, or impact, surface on its upper end for receiving blows by an impact tool. The knocker bit has a downward facing amplification spring seat, proximate the hammer surface, which provides a seat for at least a portion of the upper ends of the amplification springs. An upward facing amplification spring seat is positioned on a bottom sub at the lower end of the amplification device. The upward facing amplification spring seat provides a seat for at least a portion of the lower ends of the amplification springs and contains an anvil surface at its upper end.

The amplification device may be coupled to an oscillating device. The oscillating device may have an eccentric member that creates oscillation of at least a part of the bottom hole assembly, such as that found in U.S. Patent Application Publication No. 2012/0247757, which application is incorporated herein by reference as if fully reproduced herein. The oscillating device generates high revolutions per minute and imbalanced rotational frequency based on pressure and the fluid's flow rate. The amount of free sting available will also contribute to the magnitude of the oscillation affects. The oscillating device may be connected directly to the amplification device or indirectly. Typically, the oscillating device is run directly above the amplification and impact devices to provide multiple frequency directions. Meaning, the impact tool and amplification device provide axial frequency, while the oscillator provides rotational frequency.

In an exemplary embodiment the impact tool is a 7.3025 cm (2.875 inch) dual stage tool. The top end of the tool incorporates a dual acting valve mechanism that relieves a spring loaded triggering mechanism thereby accelerating a piston to an internal stop creating a high energy internal impact in a timed sequence with dual acting (up and down) impulses controlled by pressure and fluid, including without limitation gas, volumes. The energy generated in the top section of the tool is thus converted to lateral, or axial, hertz frequency. The combination of the impact tool, amplification device, and oscillating device is a unique tool that generates both axial and radial hertz frequency that assist in the efficiency of extended reach drilling, including without limitation, lateral drilling.

The valve assembly and other aspects of the impact tool may be found in U.S. Patent Application Publication No. 2009/0301744, which application is incorporated herein by reference as if fully reproduced herein.

Other features and advantages of the various embodiments of the invention will be apparent from the following detailed description, the accompanying drawings, and the appended claims.

BRIEF DESCRIPTION OF THE DRAWINGS

For a more complete understanding of the embodiments of the invention, reference is now made to the following Detailed Description of Various Embodiments of the Invention, taken in conjunction with the accompanying drawings, in which.

DETAILED DESCRIPTION OF EXEMPLARY EMBODIMENTS

Figure 1:
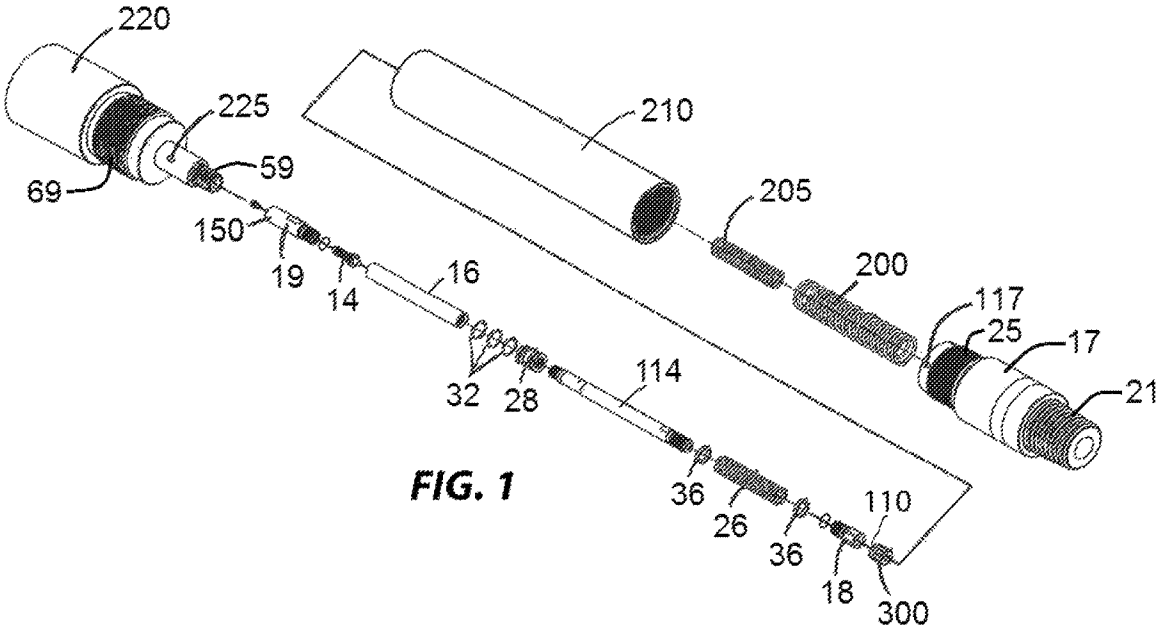
FIG. 1 is an exploded view of an exemplary embodiment of an amplification device in use with an exemplary impact tool.

The described exemplary and alternative embodiments of the amplification device are best understood by referring to the drawings, like numerals being used for like and corresponding parts of the various drawings. As used herein, "upper" will refer to the direction of the uppermost sub 220 that connects to a drill string or tubing (not shown). As used herein, "lower" will refer to the direction of the bottom sub 17.

Figure 2A:
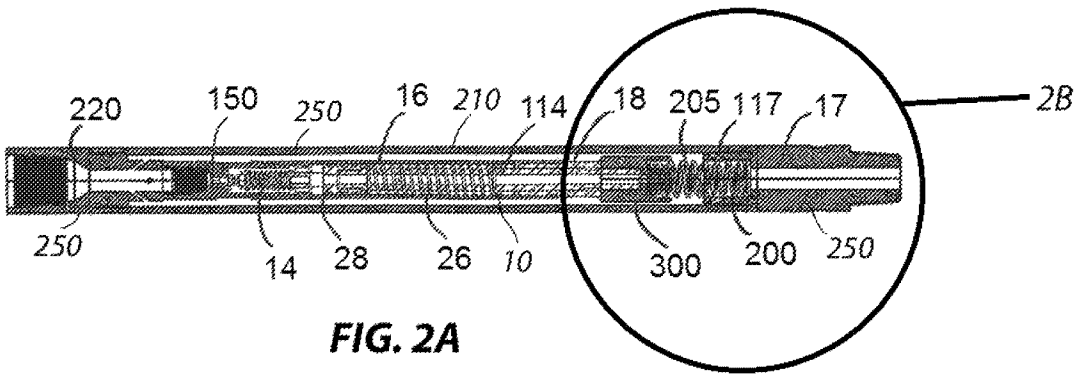
FIG. 2A is a longitudinal, cross-sectional view of the assembled exemplary embodiment of FIG. 1.
Figure 2B:
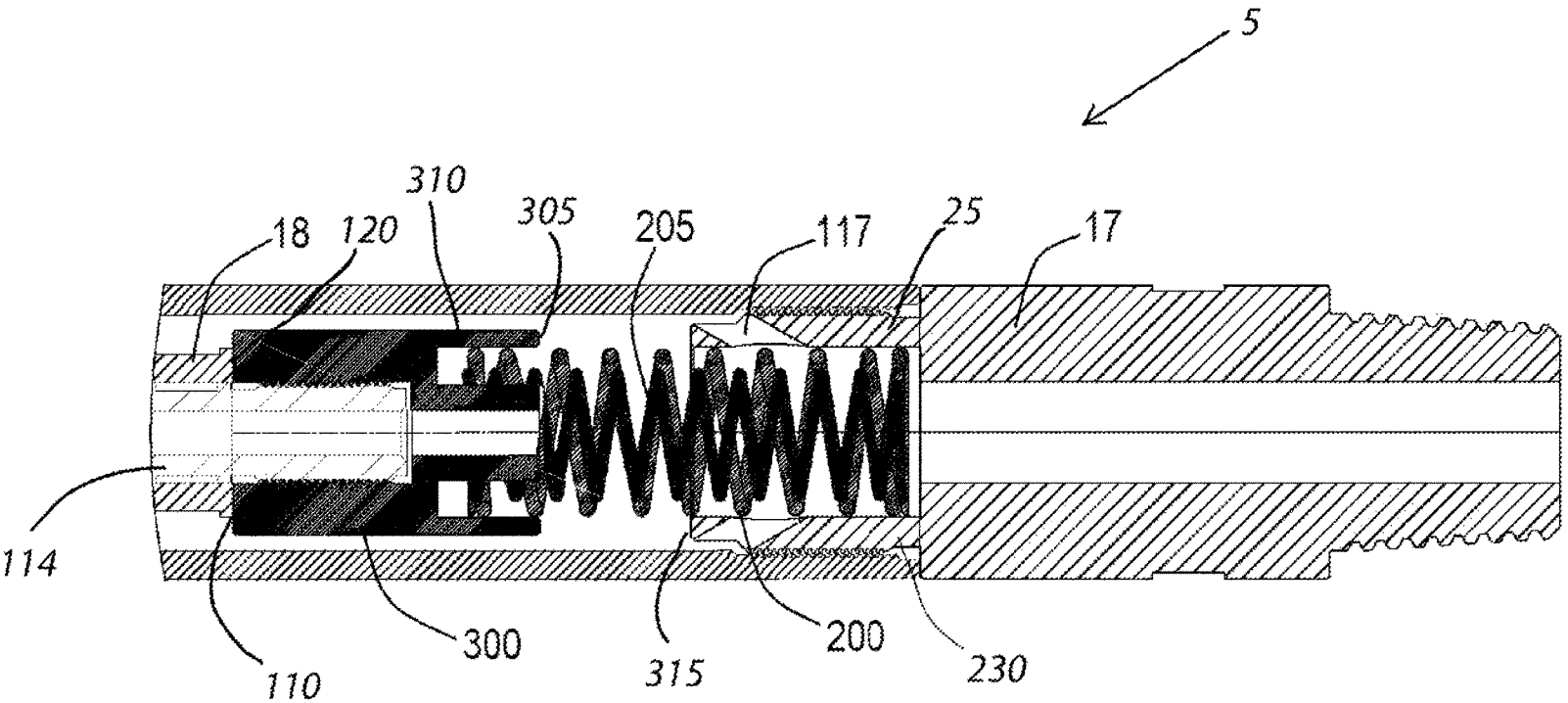
FIG. 2B is a cross-sectional view of the section labeled 2B in FIG. 2A.

In FIGS. 1, 2A, and 2B there is shown an exemplary embodiment of the amplification device 5 as assembled with an exemplary impact tool 10. It is understood that any number of configurations of impact tools 10 may be utilized with the described amplification device 5. Further, any number of actuation systems may be utilized in order to actuate the impact tool 10 and/or the amplification device 5.

The amplification device 5 generally includes an outermost sleeve 250 containing amplification springs 200 and 205, a knocker bit 300 having a seat for one end of the amplification springs 200 and 205, and a lower end spring seat 230 for the opposite ends of said amplification springs 200 and 205. In the exemplary embodiment depicted, the outermost sleeve 250 is comprised of an uppermost sub 220, an outermost barrel 210, and a bottom sub 17.

Figure 14A:
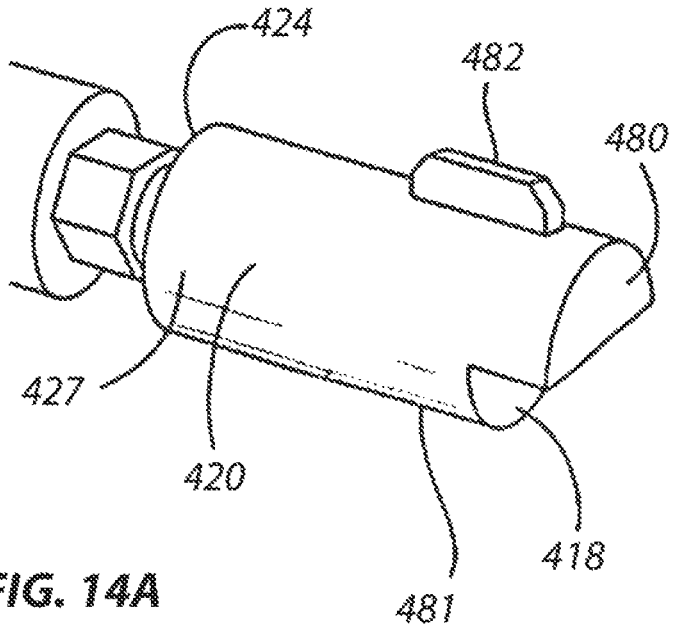
FIG. 14A is a perspective view of an exemplary eccentric member of an exemplary oscillation device.
Figure 14B:
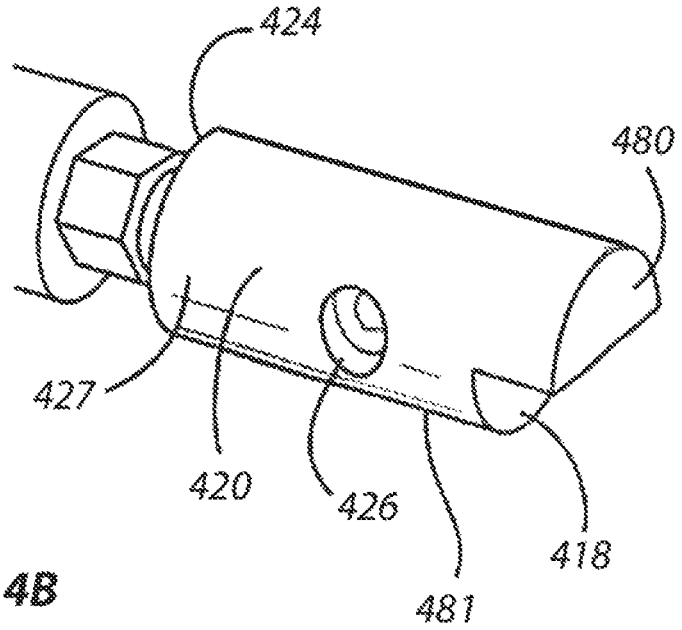
FIG. 14B is a perspective view of an alternative exemplary eccentric member of an oscillation device.

Referring to FIGS. 1, 2A, 2B, 10A, 10B, 11A, 11B, 11C, 12A, 12B, 13A, and 13B, the bottom sub 17 has a lower connector 21, which is depicted in this exemplary embodiment as a set of external threads, at its lowermost end for connection to the work string or drill bit (not shown). The lower connector 21 may be used for connection, either directly or indirectly, to at least one oscillating device for concurrent use downhole. It has been shown that the combination of the amplification device 5 and an oscillating device, when used downhole for drilling, acts to increase the drilling speed. This is especially useful for lateral drilling or off-vertical drilling. An exemplary oscillating device may be found in U.S. Patent Application Publication No. 2012/0247757. Exemplary eccentric members 480 of an oscillating device are also depicted in FIGS. 14A and 14B.

Figure 12B:
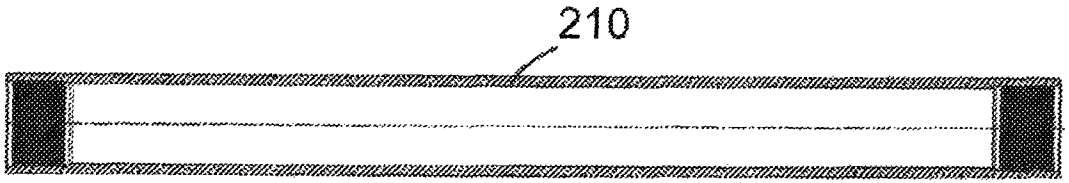
FIG. 12B is a longitudinal cross-sectional view of FIG. 12A through line A-A.
Figure 12A:
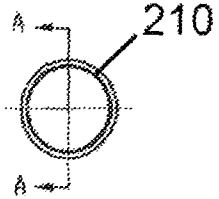
FIG. 12A is a front view of an exemplary outermost barrel.
Figure 13A:
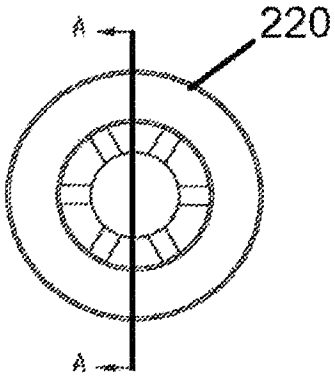
FIG. 13A is a front view of an exemplary uppermost sub.
Figure 13B:
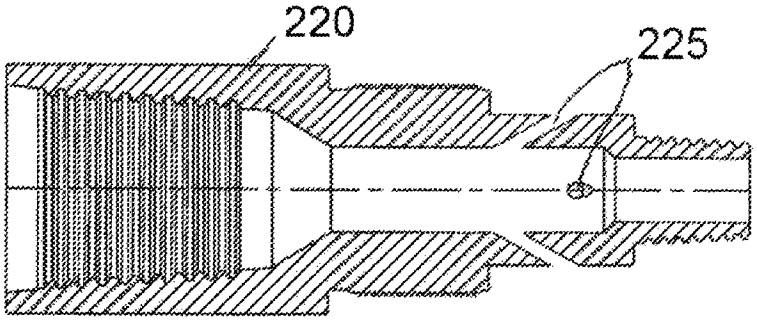
FIG. 13B is a longitudinal cross-sectional view of FIG. 13A through line A-A.

The bottom sub 17 also has an outermost barrel connector 25, which is depicted in this exemplary embodiment as a set of external threads, distal its lower connector 21, for connection to one end of the outermost barrel 210. The outermost barrel 210, see FIGS. 12A and 12B, is a generally cylindrical barrel having connectors located at each of its ends. The exemplary embodiment depicts internally threaded connector sections at each end of the outermost barrel 210. The outermost barrel 210 is connected at its lower end to the bottom sub 17 and at its upper end to the uppermost sub 220 via the connector sections.

The knocker bit 300 is a generally cylindrical member having a bore extending therethrough. The knocker bit 300 has an impact tool connection end 303 at its upper end for connection to an impact tool. The exemplary embodiment depicted utilizes internal threading at the connector end 303 for connection to an impact tool; however, any connection means may be utilized. Typically, the knocker bit 300 will connect to the mandrel 114 of an impact tool.

The knocker bit 300 has an impact surface 110 on its uppermost face. The impact surface 110 acts as the anvil to the impact tool's 10 hammer surface 120.

Knocker bit 300 has a downward facing amplification spring seat 310 surrounding its inner bore for placement of at least a portion of the upper ends of the amplification springs 200 and 205. The knocker bit 300 has a hammer surface 305 at its lower end which will impact a corresponding anvil surface 315. The exemplary embodiment depicted has the anvil surface 315 on the upper end of the upward facing amplification spring seat 230 of the bottom sub 17.

Figure 11B:
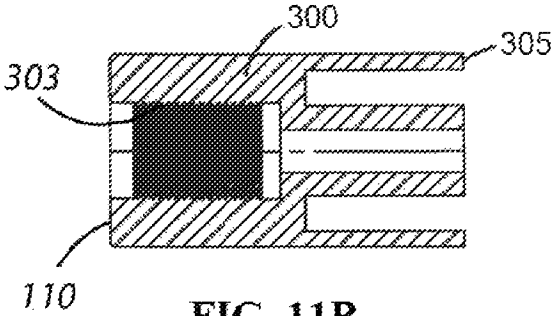
FIG. 11B is a longitudinal cross-sectional view of FIG. 11A through line A-A.
Figure 11C:
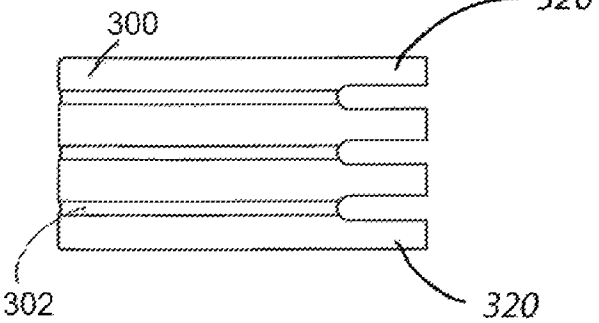
FIG. 11C is a side view of an exemplary knocker bit.
Figure 11A:
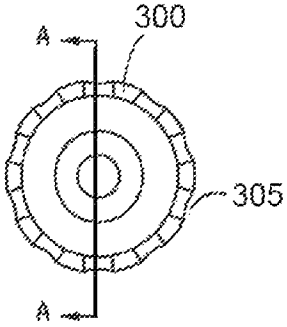
FIG. 11A is a front view of an exemplary knocker bit.

Referring to FIGS. 11A, 11B, and 11C, the hammer surface 305 may be composed of interspaced protrusions 320 extending from the body of the knocker bit 300. Alternatively, the hammer surface 305 may be a smooth solid surface or may comprise any combination of the foregoing. In operation, the impact tool will actuate thereby striking the impact surface 110 of the knocker bit 300. The impact will at least partially compress the amplification springs 200 and 205 causing the hammer surface 305 of the knocker bit 300 to strike the anvil surface 315 of the bottom sub 17. This strike will provide additional impact load and actuate the dual amplification springs 200 and 205 causing them to recoil at the end of the strike, thereby aiding to reset the impact tool, while also providing an upward thrust.

The amplification springs 200 and 205 will act to repulse the knocker bit 300 and reset same for the next hammering event thereby increasing the speed at which the impact tool, that the amplification device 5 is acting on, will reset for the next impact. Further, the additional hammering action provided by the amplification device 5 will increase the impact load delivered by the combined devices. The frequency of the hammering may be controlled by pressure of the fluid that flows through the impact tool 5 and/or the volume of that fluid. In an exemplary embodiment, the hammering cycles will occur at about 500 cycles per minute, producing a lateral (axial) frequency of 95-96 hertz. The cycles and frequency may be changed as needed.

The amplification springs 200 and 205 are contained, at least partially, within the respective seats 310 and 230. This containment helps to prevent lateral movement of the amplification springs 200 and 205. In the exemplary embodiment depicted, the bottom sub 17 houses the upward facing amplification spring seat 230. The upward facing amplification spring seat 230 protrudes from the body of the bottom sub 17 within the interior bore of the outermost barrel connector 25. The bore within the upward facing amplification spring seat 230 is adapted to house at least a portion of one end of the amplification springs 200 and 205. The inner bore of the lower end spring seat 230 may be larger, smaller, or the same size as the remainder of the bore that extends through the bottom sub 17.

Figure 10B:
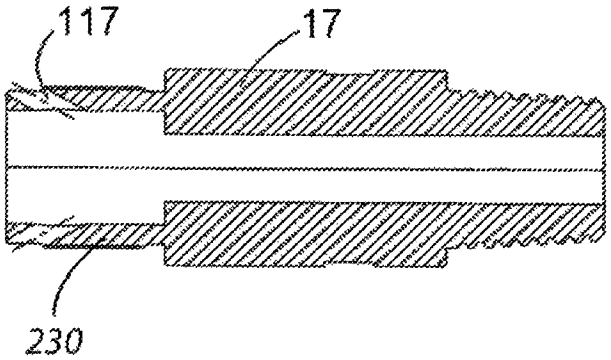
FIG. 10B is a longitudinal cross-sectional view of FIG. 10A through line A-A.
Figure 10A:
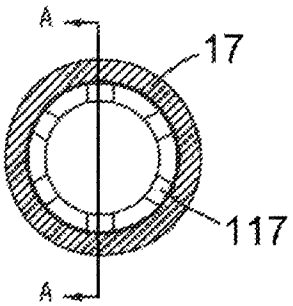
FIG. 10A is a front view of an exemplary bottom sub.

Referring to FIGS. 2B, 10A, and 10B, the upward facing amplification spring seat 230 may contain ports 117 spaced about its circumference. The ports 117 extend through the wall of the lower end spring seat 230 providing a passageway between the interior of the bottom sub 17 and the interior of the outermost barrel 210. This passageway may be in addition to a passageway directly thorough the inner bore of the bottom sub 17.

Inner amplification spring 205 is smaller in diameter in relation to outer amplification spring 200. The inner amplification spring 205 may also be smaller in length in relation to the outer amplification spring 200. In that case, due to the relatively shortened length of the inner amplification spring 205 in relation to the outer amplification spring 200, the ends of the inner amplification spring 205 may not extend within the full length of either seat 230 and/or 310 when the amplification device is assembled in its initial uncompressed position. In the embodiment depicted in FIG. 2B, the amplification springs 200 and 205 are the same length. Inner amplification spring 205 fits inside outer amplification spring 200 when positioned in the respective spring seats 310 and 230 of the knocker bit 300 and bottom sub 17, respectively. Inner amplification spring 205 may be less compressible than outer amplification spring 200.

Referring to FIGS. 1, 2A, 2B, 13A, and 13B, the uppermost sub 220 has a work string inner connector 61 at its upper end for connection to the work string (not shown). The uppermost sub 220 has two sets of external connectors 59 and 69. The external threading 59 is located proximate the uppermost sub's 220 lower end. The external connector 59 is used to connect the uppermost sub 220 to an impact tool. Referring to FIG. 2A, there depicted is an exemplary method of connecting the amplification device 5 to the exemplary impact tool 10 via the impact tool's upper sub 19. The upper sub 19 of the impact tool 10 has a work string connector 67 at its uppermost end. As depicted, the external connector 59 of the uppermost sub 220 connects to the work string connector 67 of the depicted impact tool 10. Optionally, a spacer (not shown) is placed between the upper sub 19 and the uppermost sub 220 when they are connected.

The external threading 69 is intermediate the impact tool connector 59 and the work string connector 61. The external connector 69 allows for connection of the uppermost sub 220 to the outermost barrel 210 to form part of the outermost sleeve 250.

Fluid will enter the amplification device 5 through the uppermost sub 220. With regard to the impact tool 10 depicted, some of this fluid will continue down the internal bore of the uppermost sub 220 and travel into the impact tool 10 thereby activating the valve assembly 14. Activation of the valve assembly 14 will function to activate the amplification device 5. It is noted that the amplification device 5 may be used with a variety of impact tools and not just the impact tool 10 depicted herein, wherein, the activation of the various impact tools will act to activate the amplification device as depicted herein. The fluid will continue to move through the impact tool 10 and will then move through the lower end of the amplification device 5, exiting out of the bottom sub 17.

One or more ports 225, on the uppermost sub 220, are disposed intermediate the impact tool connector 59 and the outermost barrel connector 69 of the uppermost sub 220. The ports 225 extend through the wall of the uppermost sub 220, allowing fluid communication between the interior bore of the uppermost sub 220 and the exterior of same. When in the assembled state, the exemplary amplification device 5 allows fluid to exit the interior bore of the uppermost sub 220 through the ports 225 and flow into the interior of the outermost barrel 210. This allows any excess fluid that is entering the amplification device 5 to travel through ports 225 and into the interior of the outermost barrel 210, between the outermost barrel 210 and the barrel 16, and past the exterior of the lower sub 18 and the knocker bit 300. This fluid will enter through the ports 117 in the bottom sub 17 or directly through the internal bore of the lower end spring seat 230 of the bottom sub 17 and back into the common internal bore of the amplification device 5.

The exterior of the knocker bit 300 (see FIGS. 11A, 11B, and 11C), may contain axially extending grooves 302 interspersed along its circumference. The grooves 302 provide passageways for fluid to wash through and flow into the bore and ports 117 of the bottom sub 17.

Figure 3:
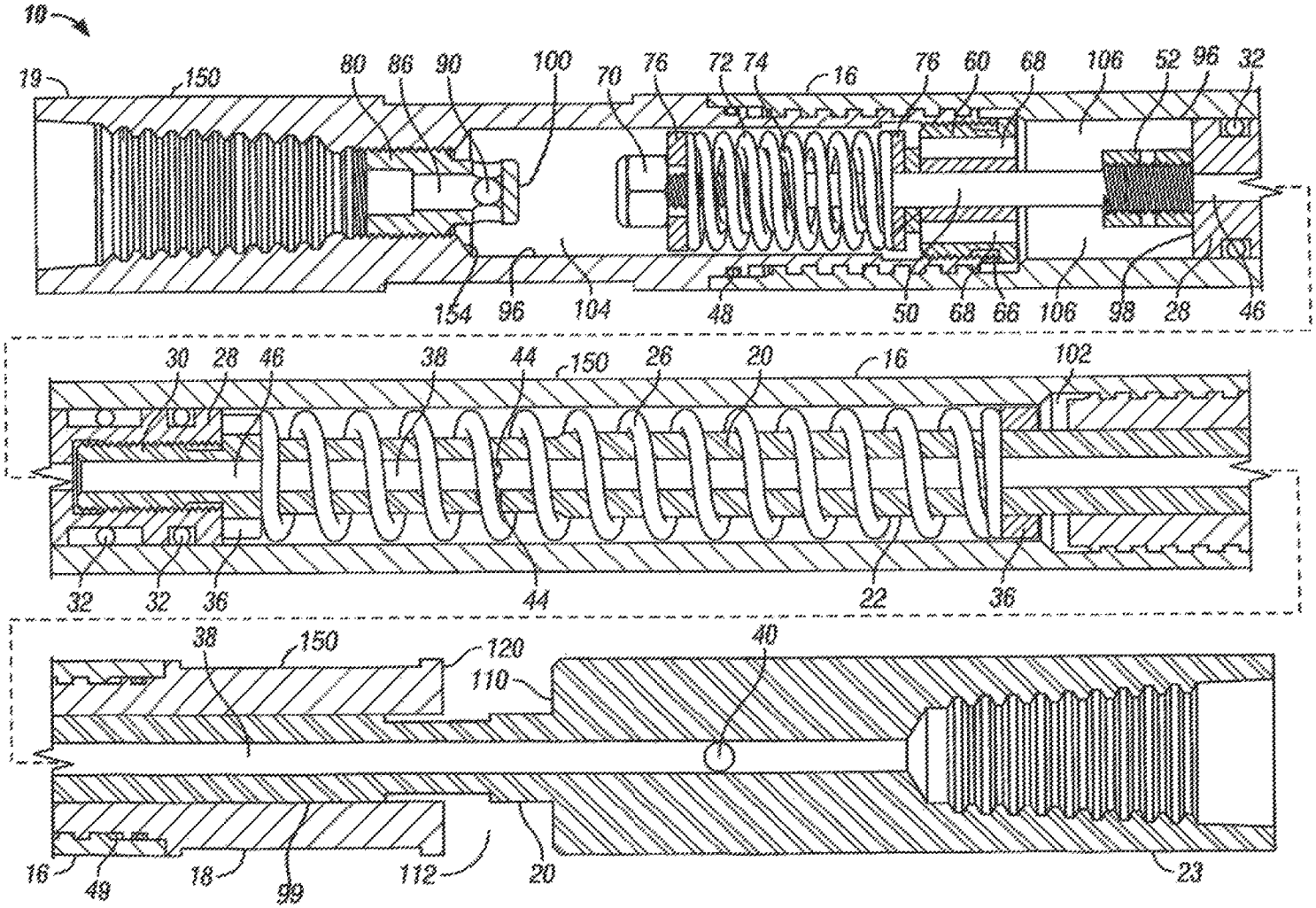
FIG. 3 is a longitudinal, partial cross-sectional view of an exemplary embodiment of an exemplary impact tool in a substantially retracted position, taken along the centerline of the tool, which impact tool may be used with the disclosed amplification device.
Figure 4:
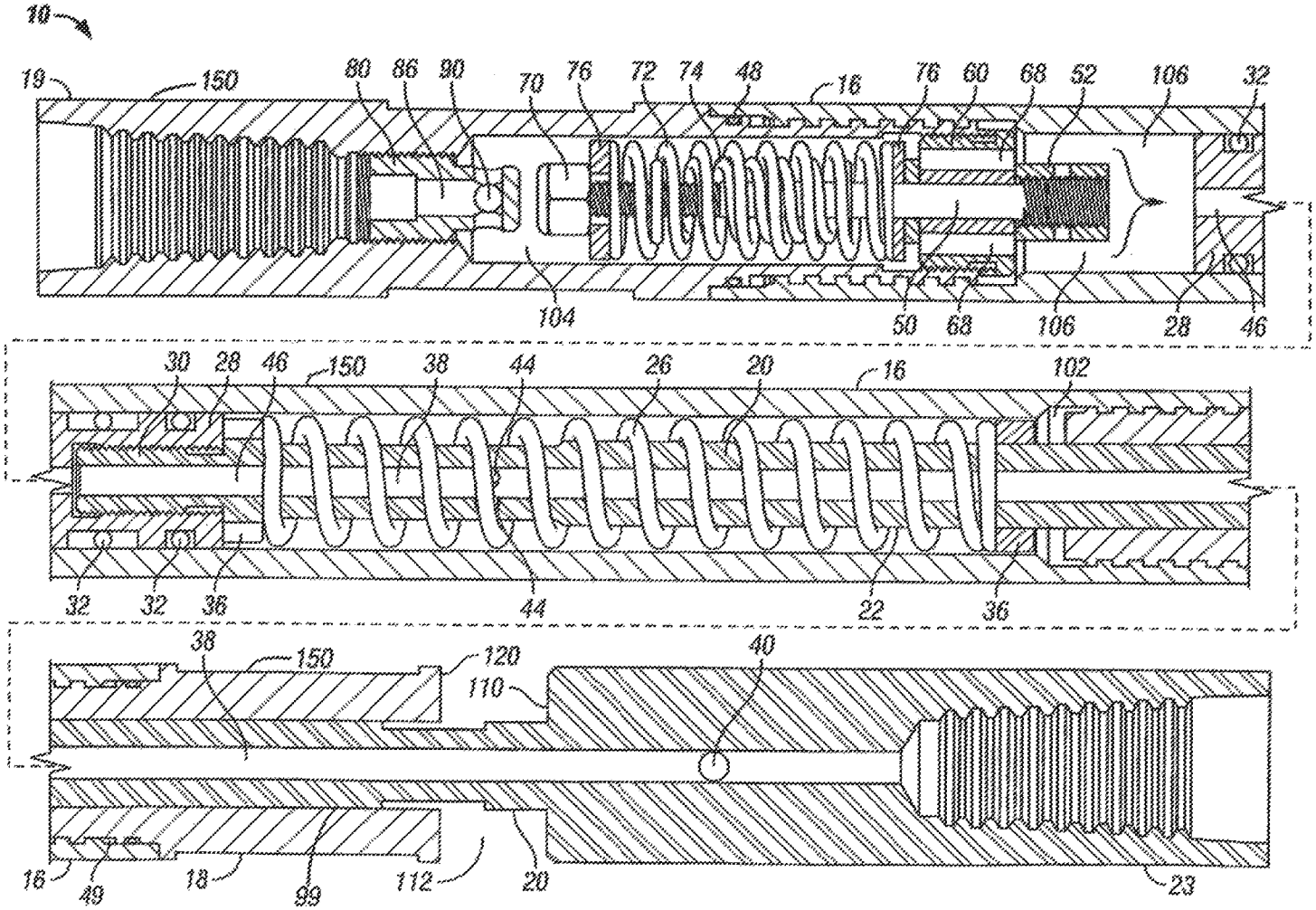
FIG. 4 is a longitudinal, partial cross-sectional view of the exemplary embodiment of FIG. 2A depicting the exemplary impact tool shortly after the initiation of the downstroke of the hammer.

In FIGS. 3 and 4 there is shown an exemplary embodiment of an exemplary impact tool 10. The depicted impact tool 10 generally includes an upper sub 19, a barrel 16, a valve assembly 14 (see FIG. 6), and an impact assembly 12 (see FIG. 5) all having a common central axis.

Figure 9:
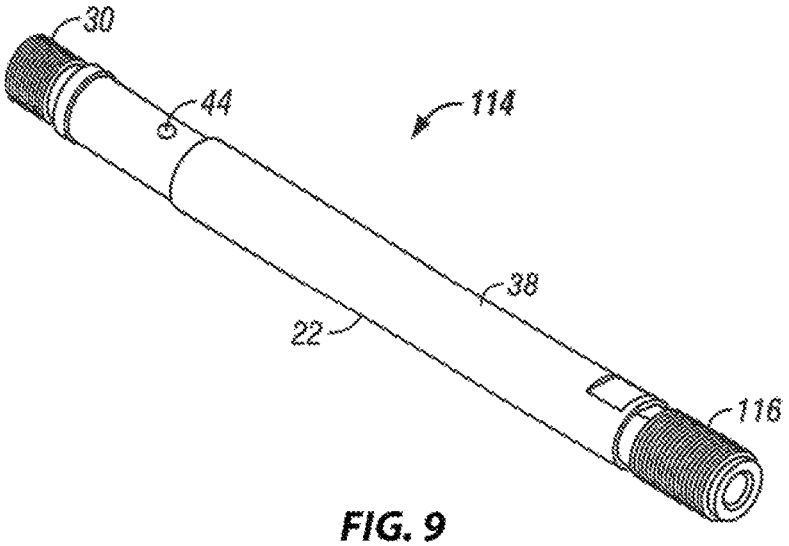
FIG. 9 is a perspective view of a mandrel of an exemplary impact tool for use with the amplification device.

The mandrel 20 depicted in FIGS. 3 and 4 contains a connection port 23. This connection port 23 is not present in the embodiments containing the amplification device 5 as the knocker bit 300 of the amplification device 5 is attached at the lower end of the mandrel 20, 114. An exemplary mandrel 114 as used with the amplification device 5 is shown in FIG. 9. The lower portion of the mandrel 114 contains a threaded end 116 for connection to the knocker bit 300.

Referring to FIG. 3, the impact tool 10 contains an outer sleeve 150 that is generally comprised of the upper sub 19, the barrel 16, and a lower sub 18. The upper sub 19 is constructed for removable attachment at its upper end to the uppermost sub 220, drill string, tubing or similar conduits (not shown) allowing for fluid flow therethrough. The upper sub 19 is attached to the barrel 16 at the lower end of the upper sub 19 and the upper end of the barrel 16. The lower sub 18 is attached to the barrel 16 distal the upper sub 19 at the lower end of the barrel 16.

Figure 7:
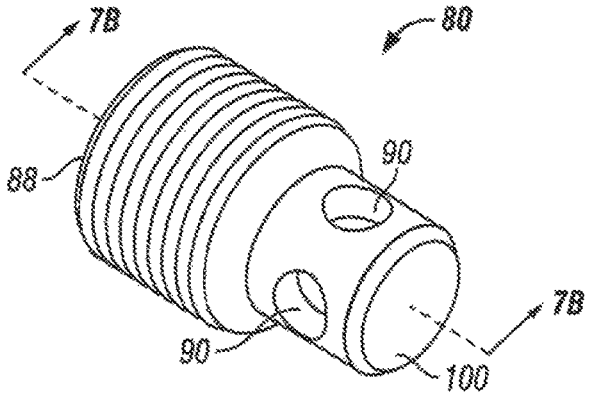
FIG. 7 is a perspective view of an exemplary embodiment of the fluid inlet screw of an exemplary impact tool.
Figure 8:
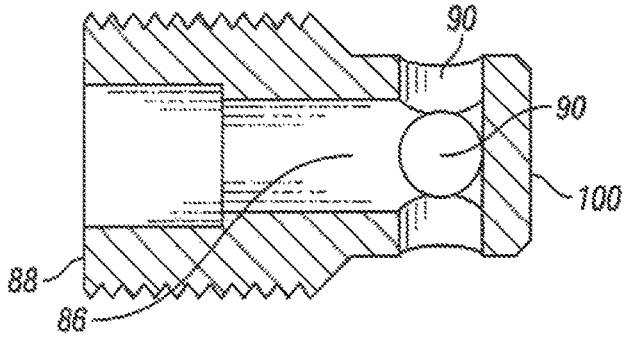
FIG. 8 is a cross-sectional view of the fluid inlet screw of FIG. 7.

Referring to FIGS. 3, 7, and 8, a fluid inlet member 80 is functionally connected within the upper sub 19. The fluid inlet member 80 is positioned proximate the upper connection end of the upper sub 19. The fluid inlet member 80 contains an axial bore 86 that is open to an upper inlet end 88 and allows the passage of fluid (not shown) into inlet end 88 and through at least one fluid port 90. The at least one fluid port 90 is positioned near a head 100 of the fluid inlet member 80 and is substantially perpendicular to the axial bore 86. The fluid exits the at least one fluid port 90 and enters an upper pressure chamber 104.

Figure 6:
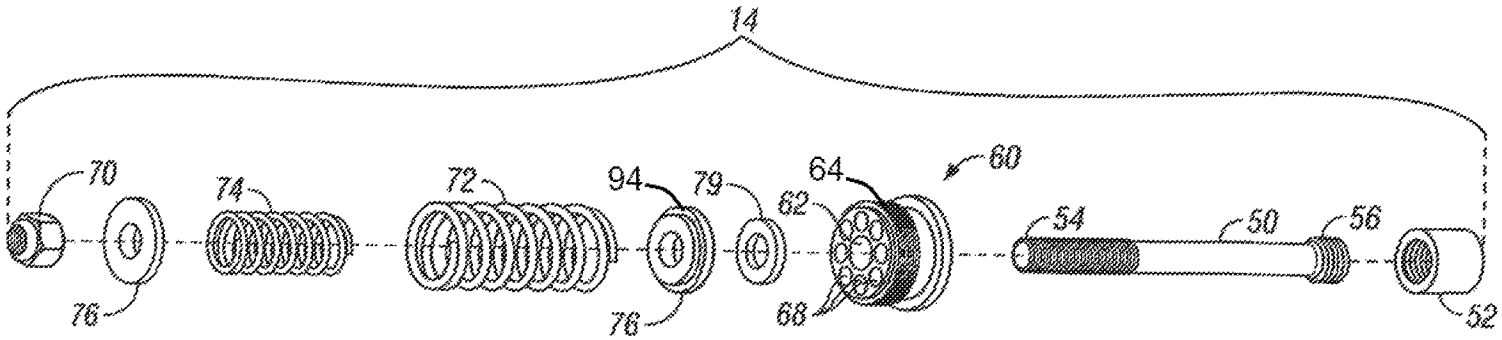
FIG. 6 is an exploded view of an exemplary valve assembly of an exemplary impact tool.

Referring to FIGS. 3 and 6, the valve assembly 14 generally includes an adjustment sleeve 52, a cap screw 50, a valve port 60, an outer compression spring 72, an inner compression spring 74, and a lock nut 70. The cap screw 50 is a generally elongated, cylindrical member with an upper end 54 and an opposite lower end 56. The adjustment sleeve 52 is attached to the lower end 56 of the cap screw 50.

The valve port 60 has a central bore 62 extending therethrough. The valve port 60 is slidable in relation to the cap screw 50, wherein the cap screw 50 is inserted through the central bore 62 such that the valve port 60 is positioned adjacent the upper end 54 of the cap screw 50. The valve port 60 contains at least one peripheral bore 68 which is provided in the body of the valve port 60 and is spaced around the central bore 62 to permit fluid flow through the valve port 60.

The inner compression spring 74 is smaller than the outer compression spring 72 both in length and in width, such that the inner compression spring 74 may fit within the outer compression spring 72 when both springs 72, 74 are concentrically positioned around the cap screw 50 intermediate the valve port 60 and the upper end 54 of the cap screw 50. The compression springs 72, 74 are slidable in relation to the cap screw 50.

The lock nut 70 is attached to the upper end 54 of the cap screw 50 in order to retain the valve port 60, inner compression spring 74, and outer compression spring 72 intermediate the lower end 56 and the lock nut 70.

The valve assembly 14 may further contain a pair of spring supports 76. The spring supports 76 are generally circular members containing an orifice therethrough. The spring supports 76 may further contain a protrusion 94 adapted to contact a corresponding end of outer compression spring 72. The concentrically contained inner compression spring 74 and outer compression spring 72 are positioned intermediate the spring supports 76 when positioned on the cap screw 50. The protrusion 94 of the spring supports 76 at least partially extends within the corresponding ends of the outer compression spring 72, thereby substantially preventing lateral movement of the outer compression spring 72. Due to the relatively shortened length of the inner compression spring 74 in relation to the outer compression spring 72, the spring supports 76 do not contact both free ends of the inner compression spring 74 when the valve assembly 14 is in its initial, uncompressed position. One or more washers 79 may be utilized in connection with the valve assembly 14 as needed.

The lower end 56 may contain a slightly larger outer diameter than that of the remaining cap screw 50 member. A purpose of which is to prevent passage of the valve port 60 over the lower end 56. A purpose of the ends 54 and 56 is to retain the components of the valve assembly 14 in a functioning relationship on the cap screw 50.

Once the valve assembly 14 is assembled, the lock nut 70 and/or the adjustment sleeve 52 may be adjusted such that the necessary pretension in the outer compression spring 72 required to allow for the proper fluid flow and pressure retention within the valve assembly system may be set. The frequency of the impact strikes may be at least partially controlled through the pretension of the outer compression spring 72 and/or inner compression spring 74. The valve port 60 is attached to the upper sub 19 by the threaded connection of the internal threading 66 of the upper sub 19 with the external threading 64 of the valve port 60, whereby the lock nut 70 is positioned adjacent the head 100 of the fluid inlet member 80, and the adjustment sleeve 52 is positioned external of the internal bore of the upper sub 19.

A seat 154 for the fluid inlet member 80, the base of the valve port 60, and the interior walls 96 of the barrel 16 intermediate thereof define the upper pressure chamber 104. The inner compression spring 74, outer compression spring 72, and lock nut 70 of the valve assembly 14 are contained within the upper pressure chamber 104.

A purpose of the valve assembly 14 is to initiate the impact strokes of the impact tool 10 by regulating the flow of fluid from the upper sub 19 through the mandrel 20, 114. The valve assembly 14 also actuates the amplification device 5.

Figure 5:
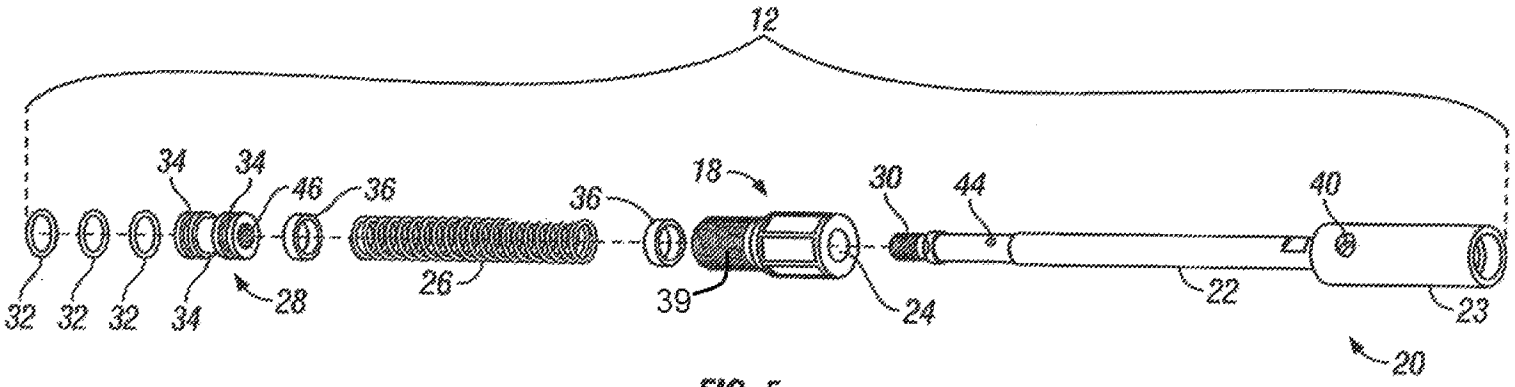
FIG. 5 is an exploded view of an exemplary impact assembly of an exemplary impact tool.

Referring to FIGS. 3 and 5, the impact assembly 12 generally includes the mandrel 20, 114, a main compression spring 26, and a piston 28. The impact assembly 12 is at least partially contained within the barrel 16. The mandrel 20 is comprised of a mandrel shaft 22 and, as depicted, a connection port 23; however, the mandrel 114 of FIG. 9 is utilized with the amplification device 5. The mandrel 20, 114 is a generally elongated, cylindrical member having a longitudinally extending internal bore 38 therethrough. The impact surface 110 of the connection port 23 acts as the anvil during the impact phase, thereby translating the impact to the lower end of the impact tool 10. When combined with the amplification device 5, the impact surface 110 is located on the knocker bit 300.

The lower sub 18, of the outer sleeve 150, contains the main compression spring 26 of the impact assembly 12 securely against the piston 28. The lower sub 18 has a threaded upper end 92 for attachment to the lower end of the barrel 16. The lower sub 18 acts as the hammer during operation wherein a hammer surface 120 of the lower sub 18 strikes the impact surface 110 of the knocker bit 300, thereby imparting an impact to the amplification device 5 at the lower end of the impact tool 10. The shaft 22 of the mandrel 20, 114 fits within the bore 24 of the lower sub 18, allowing for sliding movement therein. However, the fit between the shaft 22 of the mandrel 20, 114 and the bore 24 of the lower sub 18 is loose enough to permit some fluid flow therebetween through gap 99.

The main compression spring 26 is sized and shaped to fit over at least a portion of the shaft 22 of the mandrel 20, 114 for sliding movement thereon. The piston 28 has a longitudinally extending bore 46 therethrough. The piston 28 is attached to the upper end 30 of the mandrel 20, 114. At least one o-ring 32 is positioned on at least one groove 34 of piston 28 to form a slidable seal between the piston 28 and the barrel 16. The seal created by the at least one o-ring 32 is sufficient to prevent excess fluid flow through the interior of the barrel 16 past the exterior of the piston 28, but nonrestrictive enough to allow for movement, such as axial and/or rotational movement, of the impact assembly 12 in relation to the outer sleeve 150.

The impact assembly 12 may further contain a pair of spacers 36. The spacers 36 are generally circular members containing an orifice therethrough for positioning around the mandrel shaft 22. The spacers 36 are fitted on the mandrel shaft 22 at each end of the main compression spring 26 for sliding movement on the mandrel shaft 22. The spacers 36 are contained intermediate the piston 28 and the threaded end of the lower sub 18.

The impact assembly 12, with the lower sub 18 intermediate the connection port 23 and main compression spring 26, is inserted, piston end first, into the internal bore of the barrel 16 at the lower end of the barrel 16. The lower sub 18 is threadedly attached to the lower end of the barrel 16 through its threaded end 92. In position, the piston 28 is disposed adjacent the adjustment sleeve 52 of the valve assembly 14. The face 97 of the valve port 60, the base 98 of the piston 28, and the interior walls 96 of the barrel 16 intermediate thereof define the lower pressure chamber 106.

Referring to FIG. 3, at least one o-ring 48 is positioned between the barrel 16 and the upper sub 19 when they are attached to each other. This at least one o-ring 48 may form a seal therebetween. At least one o-ring 49 is positioned between the barrel 16 and the lower sub 18 when these parts are connected together. This at least one o-ring 49 may form a seal between the barrel 16 and the lower sub 18.

The mandrel 20, 114 and the piston 28 are slidable within the outer sleeve 150, which is generally comprised of the upper sub 19, the barrel 16, and the lower sub 18. The main compression spring 26 is compressible between the piston 28 and the lower sub 18, and therefore somewhat slidable, within the outer sleeve 150.

The mandrel 20, 114 and the piston 28 may be rotatable in relation to the outer sleeve 150. The main compression spring 26 and/or the spacers 36 may also be rotatable in relation to the outer sleeve 150.

At least one upper rotation nozzle 44 extends through the wall of the mandrel shaft 22. In an exemplary embodiment, at least two upper rotation nozzles 44 are provided spaced within the wall of the mandrel shaft 22. The at least one upper rotation nozzle 44 is in fluid communication with the internal bore 38 of the mandrel 20, 114.

The upper rotation nozzles 44 are located on the mandrel shaft 22 intermediate the piston 28 and the connection port 23. The upper rotation nozzles 44 allow fluid flow from the internal bore 38 of the mandrel 20, 114, through the upper rotation nozzles 44, and through the gap 99 between the lower sub 18 and the mandrel shaft 22.

In an alternative embodiment shown in FIGS. 7 and 8, at least one fluid port 90 is positioned on the head 100 of the fluid inlet member 80. Alternatively (not shown), at least one fluid port 90 is positioned on the head 100 of the fluid inlet member 80 and is substantially parallel to the axial bore 86, and at least one fluid port 90 is positioned near the head of the fluid inlet member 80 and is substantially perpendicular to the axial bore 86.

The various attachments and connections referred to herein may be threaded as shown or achieved by any other known means for attaching one component to the corresponding component. The various attachments may also be removably or fixedly attached.

In use, the impact tool 10 is first attached to the amplification device at the uppermost sub 220, which is attached to the lower end of a drill string (not shown), either directly or through other tools and/or tubing. The tools are then lowered downhole. Compressed air, nitrogen, water, light drilling fluid, or other suitable fluid is then introduced from the drill string into the amplification device 5 and impact tool 10 through the upper opening in the uppermost sub 220.

Referring to FIGS. 2A, 2B, 3 and 4, when the impact tool 10 is in its initially retracted, uncompressed position, main compression spring 26, inner compression spring 74, and outer compression spring 72 are in their resting, uncompressed positions. Main compression spring 26 may be pre-tensioned to allow for suitable compression to achieve the desired impact force. The lower end of the compression spring 26 bears against the upper end 102 of the lower sub 18 through spacer 36, and the upper end of the compression spring 26 bears against the piston 28 through the opposite spacer 36. Similarly the outer compression spring 72 and/or inner compression spring 74 may be pre-tensioned as necessary.

In operation, the fluid enters through the upper end of upper sub 19 and flows through the at least one fluid port 90 into the upper compression chamber 104. The fluid flows continues through the at least one peripheral bore 68 of the valve port 60 and into the lower pressure chamber 106. The fluid pushes against the piston 28. Some fluid may flow past the adjustment sleeve 52 and piston 28, prior to the sealing of the passage therethrough, and into the internal bore 46 of the piston 28 and on into the internal bore 38 of the mandrel 114. The pressure in the upper and lower pressure chambers 104, 106 will increase, thereby compressing outer compression spring 72 and pushing the adjustment sleeve 52 via cap screw 50 against the piston 28 forming a functional seal, thereby preventing significant fluid flow through to the internal bore 46 of the piston 28.

The pressure in the upper pressure chamber 104 will increase, thereby further compressing the outer compression spring 72 and forcing the adjustment sleeve 52 to push against the piston 28 via the cap screw 50. As the adjustment sleeve 52 is pushed against the piston 28, thereby pushing the impact assembly 12 down into the obstruction, the upper sub 19, the barrel 16, and the lower sub 18, collectively the outer sleeve 150, will slide over the impact assembly 12 and pull upward away from it, thereby compressing the main compression spring 26 and increasing the gap 112 between the lower sub 18 and the knocker bit 300. The pressure moving the impact assembly 12 down into the obstruction, or area to be impacted, may provide an initial impact force proportional to the force with which the impact assembly 12 is forced downward. However, there may not be in initial impact force when the tool is resting on the obstruction or the otherwise desired area.

Referring to FIGS. 3 and 4, the main compression spring 26 and the outer compression spring 72 are depicted in FIG. 3 in their nearly fully compressed states. The inner compression spring 74 is stiffer in relation to the outer compression spring 72 and does not compress as readily as the outer compression spring 72. Once the inner compression spring 74 begins to be compressed, the pressure in the lower pressure chamber 106 against the base 98 of the piston 28 increases due to the resistance of the inner compression spring 74 to compression. Once the necessary pressure is reached, the seal between the piston 28 and the adjustment sleeve 52 is broken, due to the pressure within the lower pressure chamber 106 acting on the face 97 of the valve port 60 and on the base 98 of the piston 28. The pressure contained in the lower pressure chamber 106 increases and pushes the valve port 60 and the piston 28 apart, thereby causing the valve assembly 14, due at least in part to the stiffness of the inner compression spring 74, to move away from the piston 28, functionally breaking the seal between the adjustment sleeve 52 and the piston 28. The fluid within the lower pressure chamber 106 and the upper pressure chamber 104 is then allowed to flow through the internal bore 46 of the piston 28 and into the internal bore 38 of the mandrel 20, 114.

Referring to FIGS. 3 and 4, the pressure is relieved in the upper and lower pressure chambers 104, 106 due to the release of fluid into and through the internal bore 46 of the piston 28 caused by the release of the piston 28 and adjustment sleeve 52 seal. The inner compression spring 74 and the outer compression spring 72 decompress, thereby pulling the adjustment sleeve 52 back against the face 97 of the valve port 60. The release of the pressure through the internal bore 38 of the mandrel 20, 114 decompresses the main compression spring 26, thereby forcefully closing the gap 112 between the lower sub 18 and the knocker bit 300, and causing the hammer surface 120 of the lower sub 18 to impact the impact surface 110 of the knocker bit 300. This impact force results in the compression of the dual amplification springs 200 and 205 of the amplification device 5 thereby actuating the amplification device 5. The dual amplification springs 200 and 205 are compressed allowing the hammer surface 305 of the knocker bit 300 to impact the anvil surface 315 of the bottom sub 17. This causes an amplification of the downward impact load. The dual amplification springs 200 and 205 recoil aiding in the resetting of the impact tool 10 and along with the main compression spring 26 cause an upward force allowing for dual actuation. This process is repeated rapidly in succession to produce the desired effect.

Alternatively, the amplification device 5 may be used with an oscillating device. Referring to FIGS. 14A and 14B, an eccentric member 420 of an exemplary embodiment of an oscillating device is a generally asymmetrical member with a closed end 418 and an open connection end 424. The eccentric member 420 is asymmetrical in that at least a portion of the eccentric member 420 has a larger surface area 480 than another portion of the eccentric member 420 resulting in greater weight along the larger portion 480 of the member 420 in relation to the remaining portion 481. The eccentric member 420 of the depicted exemplary embodiment is generally cylindrical; however, any shaped eccentric member may be used wherein the shape and size of the eccentric member 420 varies from that shown in the exemplary embodiment herein so long as same fulfills the purpose of providing a member with uneven weight distribution in order to produce vibration and/or oscillation in the downhole tool while in operation.

In an alternative embodiment, shown in FIG. 14A, the enlarged portion 480 of the eccentric member 420 further contains a protrusion 482 extending therefrom. The protrusion 482 aids to add more weight to the enlarged portion 480 in order to further offset the eccentric member 420. Additional or varying sized and/or weighted members 480, 482 may be utilized to produce the desired frequency of vibration when in operation. In operation, the eccentric members 420 may be changed out or reconfigured in order to produce the desired result. In an alternative embodiment, the protrusion 482 is weighted as needed to produce the desired oscillation/vibration. Further, multiple eccentric members 420 having varying protrusion 482 and/or enlarged surface area 480 sizes and weights may be provided.

Referring to FIG. 14B, a channel may extend inwardly of the eccentric member 420 from its connection end 424. In an exemplary embodiment, threading is provided on the interior surface of the eccentric member 420 proximate the connection end 424 for threaded connection to the oscillating device. While a threaded connection is show, it is understood that any type of functional coupling may be employed to affect the stated purpose.

In the exemplary embodiment shown in FIG. 14B, one or more rotation nozzles 426 are disposed in the cylinder wall 427 of the eccentric member 420. Rotation nozzles 426 are in fluid communication with the interior channel of the eccentric member 420 which in turn is in fluid communication with the fluid source. The rotation nozzles 426 extend from the interior channel out to the exterior surface 484 of the eccentric member 420. This coupling allows fluid to flow from the channel to the exterior of the eccentric member 420. In the exemplary embodiment shown, fluid enters the channel of the eccentric member 420 from the mandrel of the oscillating device.

In operation, an oscillating device having an eccentric member if positioned proximate the amplification device 5 to provide rotational frequency to the impact load. Any known or hereafter discovered oscillating device may be used with the amplification device 5, whether same uses an eccentric member such as that show in FIGS. 14A and 14B or not.

The term spring as used herein refers to any resilient member of any shape that is operable in the invention, and may be made from any suitable material. For example, the springs may be comprised of a compressible fluid.

In one example embodiment of the invention, the parts described above comprise oilfield tool quality steel, and barrel 16 is provided with a quenched-polished-quenched ("QPQ") surface hardened coating.

Various changes or modifications may be made to the disclosed embodiments without departing from the true spirit and scope of the invention as contained within the scope of the appended claims. It is understood that the invention is only limited by the claims and their equivalents.

What is claimed is:

1. An amplification device, comprising:

a knocker bit having a hammer surface proximate its lower end;

a bottom sub having an anvil surface proximate its upper end;

an outer amplification spring;

an inner amplification spring, wherein the inner amplification spring is smaller in diameter than the outer amplification spring and wherein the inner amplification spring is disposed, at least partially, within the outer amplification spring; and wherein the outer amplification spring and the inner amplification spring extend at least partially between the hammer surface and the anvil surface.

2. The device of claim 1, further comprising:

the knocker bit having a protrusion extending out at its lower end, wherein the protrusion has an internal bore, the protrusion defining a downward facing amplification spring seat;

the bottom sub having a protrusion extending out at its upper end, wherein the protrusion has an internal bore, the protrusion defining an upward facing amplification spring seat;

wherein the inner amplification spring is disposed completely within the outer amplification spring; and wherein at least a portion of the upper end of the outer amplification spring is disposed in the internal bore of the downward facing amplification spring seat and at least a portion of the lower end of the outer amplification spring is disposed in the internal bore of the upward facing amplification spring seat.

3. The device of claim 2, wherein the knocker bit has an outer surface and the outer surface contains one or more axially extending grooves.

4. The device of claim 3, wherein:

the protrusion forming the downward facing amplification spring seat wall is a series of interspersed protrusions extending from the body of the knocker bit; and wherein the hammer surface is disposed proximate the lower end of the interspersed protrusions.

5. The device of claim 4, further comprising:

an outermost sleeve comprising the bottom sub, an outermost barrel, and an uppermost sub;

the bottom sub coupled to the outermost barrel at the bottom sub's upper end and the uppermost sub coupled to the outermost barrel at the uppermost sub's upper end;

wherein the inner amplification spring and the outer amplification spring are at least contained within the outermost sleeve;

an internal bore extending axially through the uppermost sub;

a wall surrounding at least a portion of the internal bore of the uppermost sub;

one or more ports extending through the wall of the uppermost sub forming a passage from its internal bore to the exterior of the wall; and one or more ports extending through the wall of the upward facing amplification spring seat.

6. The device of claim 5, further comprising:

an impact tool disposed within the outermost sleeve;

the impact tool having a hammer surface;

the knocker bit having an impact surface proximate its upper end; and the hammer surface of the impact tool disposed proximate the impact surface of the knocker bit within the interior of the outermost sleeve.

7. The device of claim 6, wherein the device is coupled to an oscillating device.

8. An amplification device, comprising:

a downward facing amplification spring seat having a hammer surface proximate its lower end;

an upward facing amplification spring seat having an anvil surface proximate its upper end;

an outer amplification spring;

an inner amplification spring, wherein the inner amplification spring is smaller in diameter than the outer amplification spring and wherein the inner amplification spring is disposed, at least partially, within the outer amplification spring;

wherein at least a portion of the outer amplification spring is disposed within the downward facing amplification spring seat and the upward facing amplification spring seat; and wherein the outer amplification spring and the inner amplification spring extend at least partially between the hammer surface of the downward facing amplification spring seat and the anvil surface of the upward facing amplification spring seat.

9. The device of claim 8, further comprising:

a knocker bit comprising a body member having an internal bore extending therethrough;

the knocker bit body member having the downward facing amplification spring seat extending from its lower end; and wherein the outer amplification spring and the inner amplification spring are concentric.

10. The device of claim 9, further comprising an outermost sleeve, wherein the inner amplification spring, the outer amplification spring, the upward facing amplification spring seat, and the downward facing amplification spring seat are all disposed within the outermost sleeve.

11. The device of claim 10, wherein the outermost sleeve comprises:

a bottom sub, the bottom sub having, at its upper end, an upward facing amplification spring seat;

a cylindrical outermost barrel;

an uppermost sub; and wherein the bottom sub is connected to one end of the outermost barrel proximate its upward facing amplification spring seat, and the uppermost sub is connected to the other end of the outermost barrel.

12. The device of claim 11, wherein:

the upward facing amplification spring seat extends from the upper end of the bottom sub, the upward facing amplification spring seat has a wall; and the wall of the upward facing amplification spring seat has one or more ports extending therethrough.

13. The device of claim 12, wherein:

the inner amplification spring is smaller in length and is less compressible than the outer amplification spring; and the outermost sleeve is configured to allow fluid to enter its upper end and flow through the interior of the outermost sleeve and flow out of its lower end.

14. The device of claim 12, further comprising:

one or more protrusions extending from the upper end of the body of the knocker bit, wherein the protrusions form at least part of the walls of the downward facing amplification spring seat;

an impact surface on the upper end of the protrusions on the knocker bit;

an impact tool having a hammer surface; and the hammer surface of the impact tool is disposed proximate the impact surface of the knocker bit.

15. The device of claim 14, wherein an oscillating device is coupled to the device.

16. The device of claim 15, wherein the oscillating device includes an eccentric member.

17. The device of claim 16, wherein the oscillating device is attached to the upper end of the uppermost sub.

18. The device of claim 14, wherein the impact tool is connected at its upper end to the uppermost sub and wherein the impact tool is connected at its lower end to the knocker bit.

19. The device of claim 9 wherein the knocker bit has an outer surface and the outer surface contains one or more axially extending grooves.

20. The device of claim 11, further comprising:

a connector at the upper end of the uppermost sub;

an internal bore extending axially through the uppermost sub;

a wall surrounding at least a portion of the internal bore; and one or more ports extending through the wall forming a passage from the internal bore to the exterior of the wall.

* * * * *